US005644295A

United States Patent [19]

Connolly et al.

[11] Patent Number: 5,644,295

[45] Date of Patent: Jul. 1, 1997

[54] SECURITY DEVICE

[75] Inventors: Raymond Edwin Connolly, Cedar Hall; Jonathan James Whittington Griffiths, Bristol, both of United Kingdom

[73] Assignee: Permasign Limited, Bristol, United Kingdom

[21] Appl. No.: 523,473

[22] Filed: Sep. 5, 1995

[30] Foreign Application Priority Data

Sep. 5, 1994 [GB] United Kingdom ..... 9417822
Dec. 20, 1994 [GB] United Kingdom ..... 9425648

[51] Int. Cl.[6] ..... G08B 13/14

[52] U.S. Cl. ..... 340/568; 340/571; 340/665

[58] Field of Search ..... 340/568, 571, 340/572, 665; 439/225; 324/691

[56] References Cited

U.S. PATENT DOCUMENTS

| | | | |
|---|---|---|---|
| 4,000,488 | 12/1976 | Ephraim | 340/572 |
| 4,006,336 | 2/1977 | Boyden | 340/568 |
| 4,772,878 | 9/1988 | Kane | 340/568 |
| 5,012,225 | 4/1991 | Gill | 340/572 |
| 5,092,788 | 3/1992 | Pristupa, Jr. et al. | 439/225 |
| 5,237,307 | 8/1993 | Gritton | 340/568 |

FOREIGN PATENT DOCUMENTS

| | | |
|---|---|---|
| 0260330 | 9/1986 | European Pat. Off. . |
| 0663656 | 1/1995 | European Pat. Off. . |
| 2405526 | 5/1979 | France . |
| 8905481.4 | 4/1989 | Germany . |
| 4310809 | 2/1993 | Germany . |
| 2287339 | 9/1995 | United Kingdom . |
| WO94/14142 | 6/1994 | WIPO . |

*Primary Examiner*—Jeffery Hofsass
*Assistant Examiner*—Benjamin C. Lee
*Attorney, Agent, or Firm*—Darby & Darby, P.C.

[57] ABSTRACT

The present invention relates to a security device for fixing to a surface to allow relative movement of the device and the surface to be detected, and a connector for such a device.

21 Claims, 4 Drawing Sheets

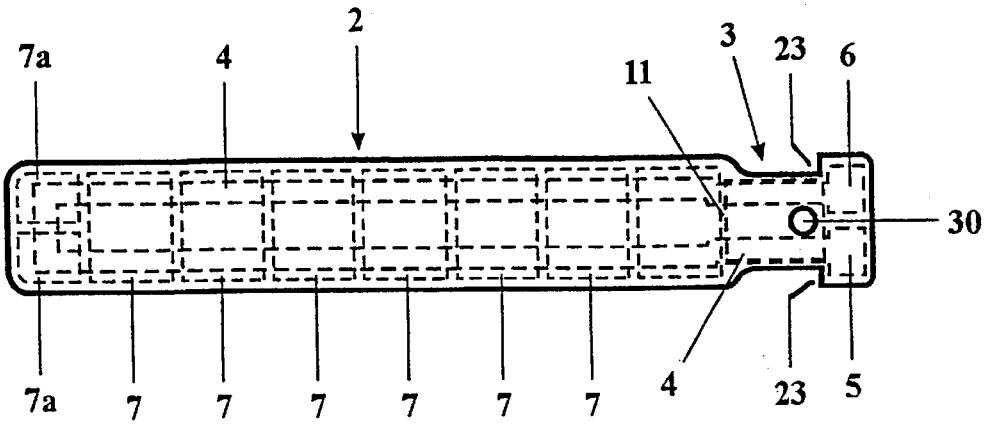
Fig. 5
Fig. 6
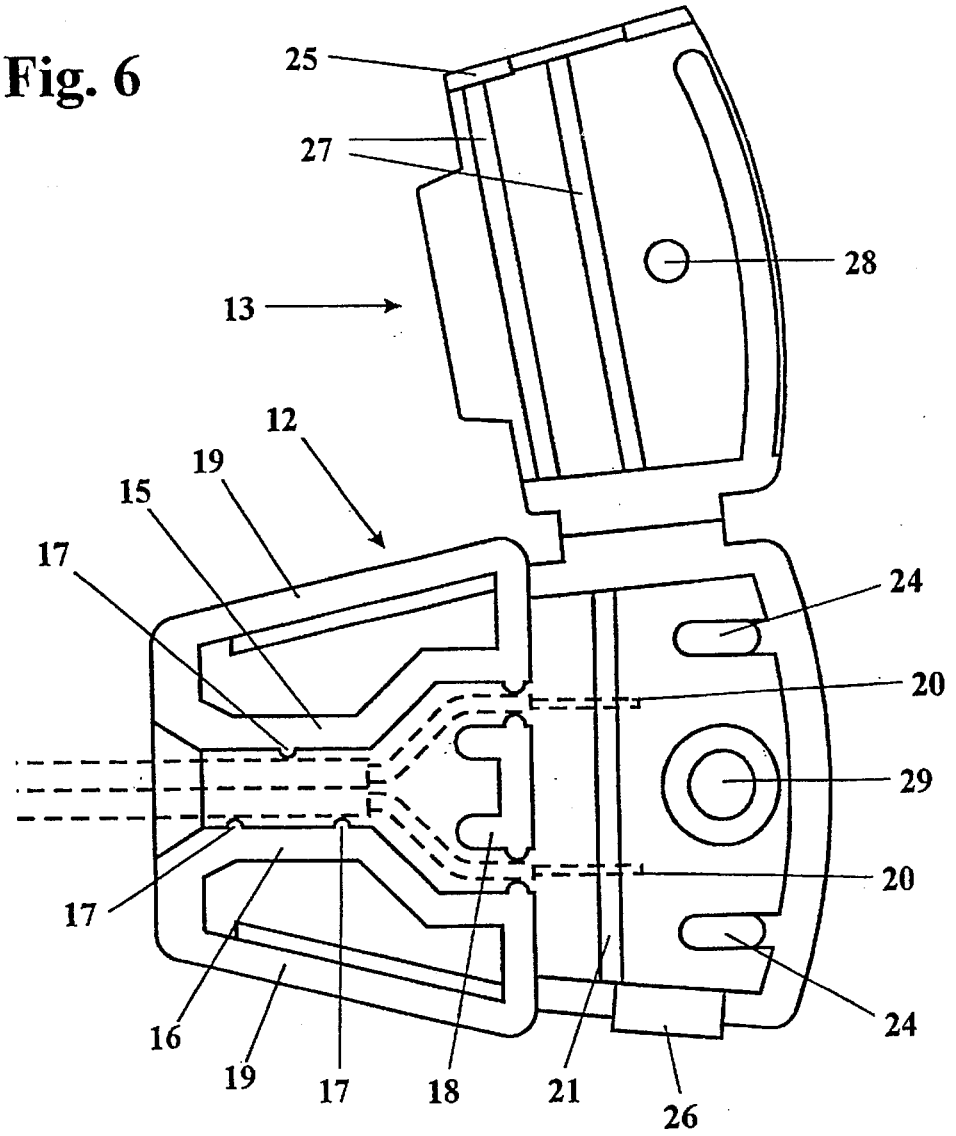

SECURITY DEVICE

BACKGROUND OF THE INVENTION

The present invention relates to a security device for fixing to a surface to allow relative movement of the device and the surface to be detected, and a connector for such a device.

In shops where valuable items are on display there is a need to prevent or inhibit thieves from stealing the items. A known device used for this purpose comprises a flexible body having a head and a tail. One side of the head bears an adhesive layer for fixing the device to a surface (which is suitably the surface of a displayed item). An electrically conductive strip, which may have some resistance, passes from one contact at the distal end of the tail, across the head (where it lies between the body and the adhesive layer) and back to another contact at the distal end of the tail. The adhesive layer is in two separate inner and outer regions. The conductive strip overlying the outer region is adhered firmly to the body and to the adhesive layer. The conductive strip overlying the inner region is adhered to the adhesive but a non-adhesive layer lies between the inner region and the body. In use, alarm apparatus is connected to the contacts to monitor the resistance between them. If an attempt is made to lift the head of the device off the surface the inner region and the portion of the conductive strip overlying it remain adhered to the surface whilst the outer region and the remainder of the conductive strip are lifted. This breaks the circuit and triggers the alarm.

This device has several problems, for example:

- it is possible for skilful thieves to prise the whole device from the surface without triggering the alarm by first lifting the edge of the device and then inserting a tool between the adhesive layer and the surface, for example from the edge of the head furthest from the tail, where the conductive strip does not pass;
- the portions of the conductive strip in the tail are exposed and a thief can therefore bypass the strip in the head by creating a short circuit of the correct resistance-across these portions.

SUMMARY OF THE INVENTION

According to the present invention from one aspect there is provided a security device for fixing to a surface to allow relative movement of the device and the surface to be detected, the device comprising: a substrate having a fixing portion by which the device may be fixed to the surface; an adhesive layer for fixing the fixing portion to the surface; and circuit means defining a circuit between two locations on the device and having predetermined electrical characterstics, at least part of the circuit means being located between the substrate and the adhesive layer and having in a first region a greater adhesion with the substrate than with the adhesive layer and in a second region a greater adhesio with the adhesive layer than with the substrate so that, when the device is fixed to the surface by said adhesive layer, relative movement of the substrate and the surface, disrupts the circuit means by measurably changing the predetermined electrical characteristics.

Preferably the device has a release layer adjacent the circuit means for reducing the adhesion of the circuit means in the second region with the substrate. The release layer suitably comprises peelable ink, most preferably stress-sensitive ink, so that it can fracture or delaminate in response to deformation of the fixing portion thereby fracturing part of the circuit means.

Preferably at least part of the circuit means is located near the periphery of the fixing portion. Most preferably, for greatest security, the circuit means passes around substantially the whole periphery of the fixing portion.

For sensitivity of the device the first region is suitably divided into a plurality of spaced apart first regions at each of which the circuit means has greater adhesion with the substrate than with the adhesive layer. Most preferably there are three or at least three such regions, suitably radially distributed about the fixing portion or distributed along the length of the fixing portion. The regions may be distributed more closely at one part of the fixing portion,,suitably the part or one of the parts which can most easily be removed from adhesion with the substrate.

The substrate is suitably opaque (this may be achieved by the substrate being coated with an opaque layer) to prevent the lower layers of the device from being seen when the device is fixed to a surface.

A contact may be provided at each of the said locations for allowing continuity or disruption of the circuit to be detected, suitably by means of a resistance monitor which may be incorporated in an alarm.

According to the present invention from another aspect there is provided a security device for fixing to a surface to allow relative movement of the device and the surface to be detected, the device comprising: a substrate having a fixing portion by which the device may be fixed to the surface; an adhesive layer for fixing the fixing portion to the surface; and circuit means defining a circuit between two locations on the device, at least part of the circuit means being located between the substrate and the adhesive layer; and a release layer located adjacent the circuit means and between the adhesive layer and the substrate, the release layer being sensitive to stress to cause the circuit means to be disrupted if relative movement of the substrate and the surface occurs when the device is fixed to the surface by the adhesive.

According to the present invention from another aspect there is provided a security device for fixing to a surface to allow relative movement of the device and the surface to be detected, the device comprising: a substrate having a fixing portion by which the device may be fixed to the surface and an elongate limb extending from the fixing portion; an adhesive layer for fixing the fixing portion to the surface; circuit means defining a circuit between two locations on the elongate limb, at least part of the circuit means being located between the substrate and the adhesive layer and being capable of disruption to sense relative movement of the substrate and the surface when the device is fixed to the surface by the adhesive; and an insulating layer extending along the limb, at least part of the circuit means being located between the limb and the insulating layer.

According to the present invention from another aspect there is provided a connector for making electrical connection between at least one contact of a device and at least one wire, the connector comprising:

- a base means for receiving the wire and having engagement means for engaging the wire to hold it in position on the base means over a contact region of the base means; and
- a contact cover engageable with the base means to sandwich the wire and the contact between the contact region and the contact cover, the contact region and the contact cover being formed cooperatively to urge the contact against the wire.

Preferably the contact cover is hingable with the base means.

Preferably at least one of the contact cover and the contact region has a projection for urging the contact against the wire. Most preferably both the contact cover and the contact region have cooperating projections.

Preferably the contact cover has an adhesion means for adhering to the device. Preferably the adhesion means comprises means for making frictional engagement with the device. Most preferably the adhesion means comprises a projection on the contact cover which can suitably make frictional engagement with a corresponding hole in the device.

The device is suitably a securing device as described herein.

BRIEF DESCRIPTION OF THE DRAWINGS

The present invention will now be described by way of example with reference to FIGS. 1 to 6 of the accompanying drawings in which:

FIG. 5 is a schematic plan view of a third security device; and

FIG. 6 is a partial plan view of a connector.

DETAILED DESCRIPTION OF THE PREFERRED EMBODIMENT

Figure 1:
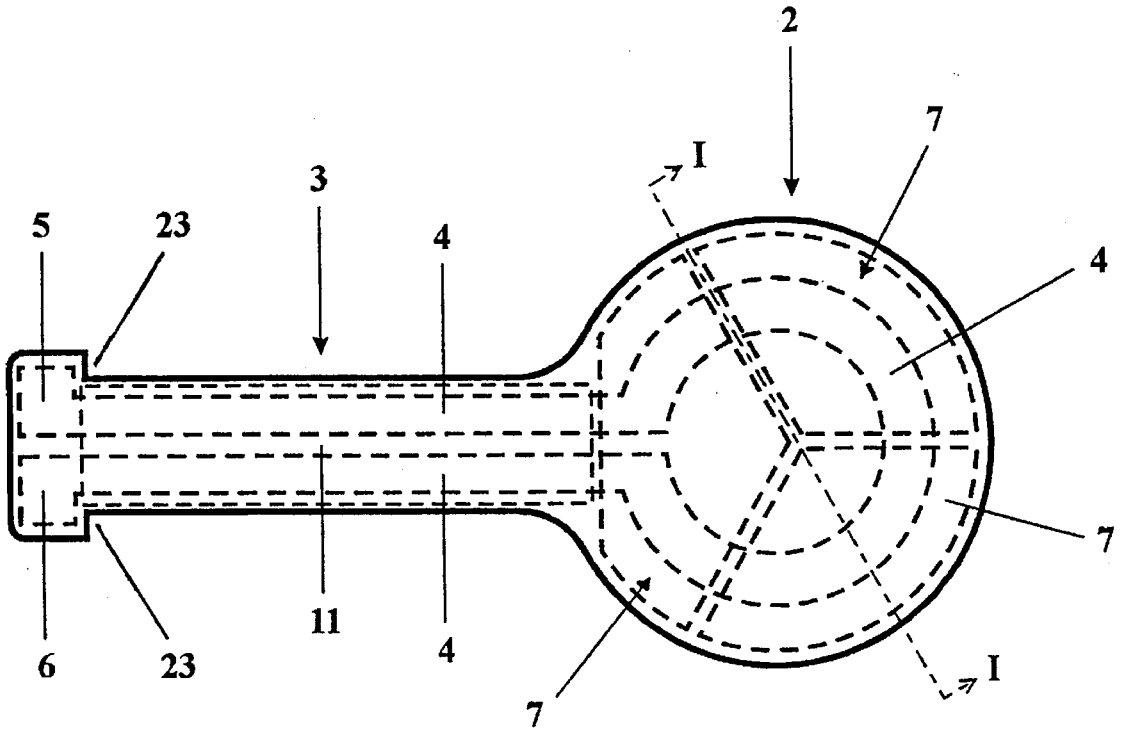
FIG. 1 is a schematic plan view of a security device.
Figure 3:
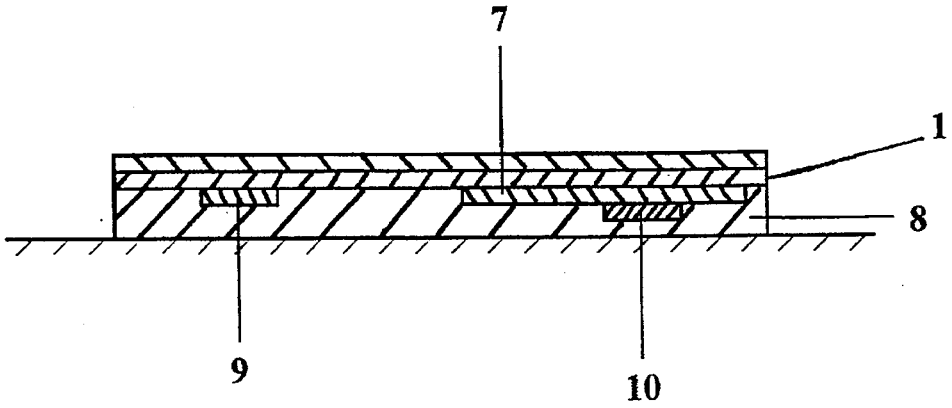
FIG. 3 is a cross section on the line I—I of FIG. 1 showing the device of FIG. 1 fixed to a surface.
Figure 2:
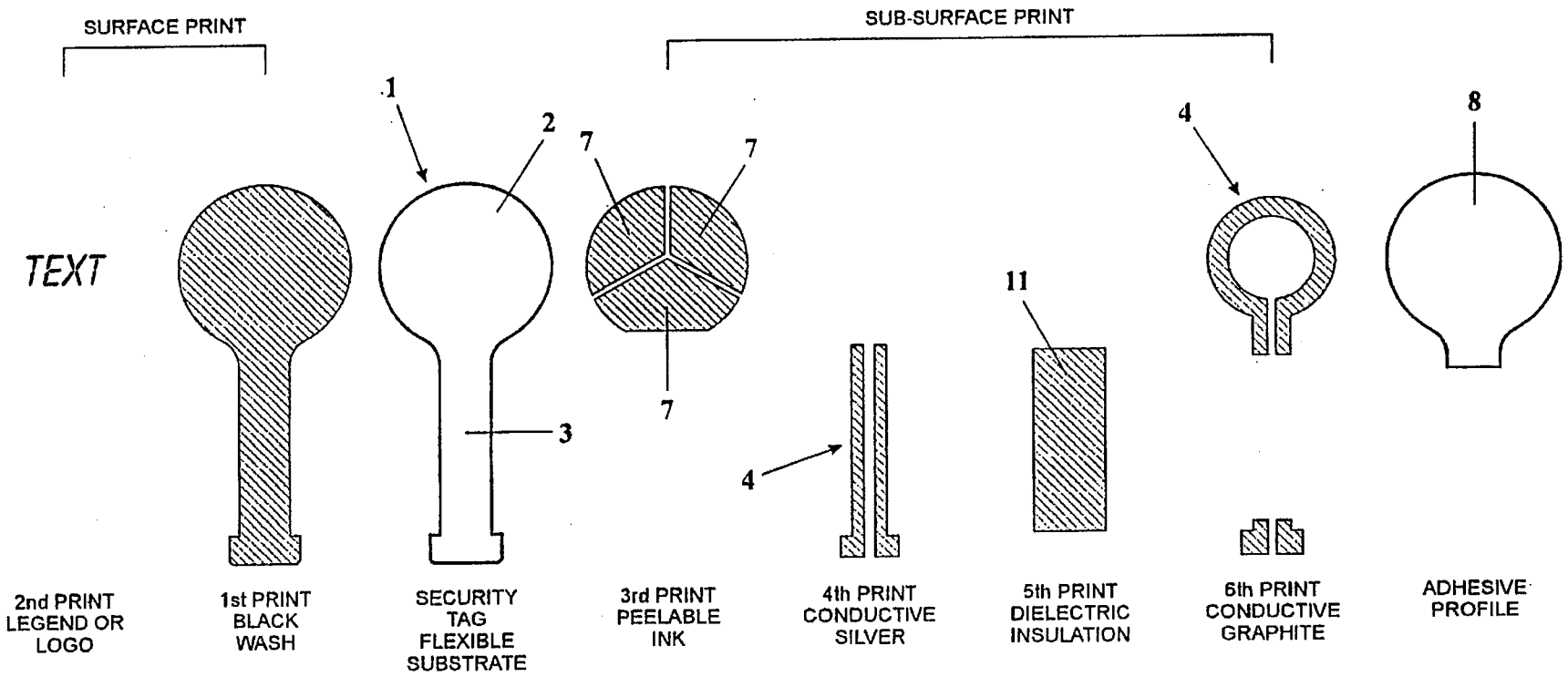
FIG. 2 is an exploded view of the device of FIG. 1.

The device shown in FIGS. 1 to 3 has a flexible laminar upper member 1 having a head portion 2 and an elongate tail 3. A frangible, electrically conductive track 4 passes from a contact 5 at the distal end of the tail, down the tail, around the head near its periphery and back to a contact 6. Between the track and the head lie three regions 7 of a release layer which bonds relatively weakly to the upper member. An adhesive layer 8, for fixing the head to a surface, underlies the release layer and the track. The bond directly between the adhesive layer and the track is weaker than that directly between the track and the upper member but stronger than that directly between the release layer and the upper member. In use, when the device is fixed to a surface and an attempt is then made to lift it from the surface the track breaks into portions 9 (FIG. 3) remaining fixed to the upper member but not the adhesive layer and portions 10 (FIG. 3) remaining fixed to the adhesive layer. This disrupts the circuit between the contacts and the change in resistance between the contacts can be used in the conventional way to trigger an alarm.

The upper member is made of a thin, flexible sheet which can be printed on and which provides a substrate to bear the other layers. The upper member could be made of polyester (particularly heat-stabilised polyester), PVC, polycarbonate or paper. On the upper surface of the upper member are printed opaque, hard wearing, scuff-resistant inks to suitably decorate the surface and hide the lower layers from view when the device is fixed to a surface.

The release layer is a layer of a delaminating substance, for example a peelable ink (such as Coates Lorilleux COSOL 19-75 black) or a combination of inks, printed on the lower surface of the upper member. The release layer bonds relatively weakly to the upper member and the conductive track. Around the periphery of the head there is a region where there is no release layer and the adhesive layer bonds directly to the upper member to ensure that the upper member may be fixed securely to the surface and to seal the interior of the device. The release layer is preferably relatively brittle and/or sensitive to stress so that if any part of the head is deformed, for example as an attempt is made to pull its edge from a surface, or if the substrate is pulled away from the adhesive layer the release layer (or at least part of it) will shatter and/or delaminate and/or release from the upper member or the track and disrupt the conductive track (suitably by breaking the track completely at at least one point).

The release layer is divided radially into three regions so that there are several locations where adjacent portions of the track are bonded directly to the upper member and directly to the release layer. The track is most likely to be disrupted at these locations. Three radially dispose regions of release layer have been found to give a suitable sensitivity to the device.

In the head the conductive track is formed of a conductive ink, for example a carbon-bearing ink, and has a resistance. Along the tail the conductive track has a very low resistance and is made, for example of a silver-loaded ink. At the distal end of the tail the silver-loaded ink is coated on its lower surface with carbon to prevent the silver from corroding and provide the contacts to which monitoring apparatus may be connected when the device is in use. An alarm can be made to sound if the circuit is disrupted and there is a change in the resistance: either an increase if the track is broken or damaged or a decrease if the resistive portion of the carbon track is short-circuited (by a conductive implement, such as a blade, being used to remove the device).

The conductive track extends substantially all around the head, and near the periphery of the head, to increase the sensitivity of the device to lifting of any part of the periphery of the head from the surface.

An insulating dielectric layer 11 made of insulating ink covers the lower surface of the conductive track along the tail to protect the track from accidental shorting and to prevent the device from being shorted by a thief connecting the correct resistance across the tracks in the tail (this might otherwise allow the device to be removed from the surface without the alarm being triggered).

The adhesive layer has a tissue carrier (not shown in the figures) and is suitably chosen to have instant, strong adhesion to a surface and to be capable of conforming and/or adhering well to textured surface surfaces. The adhesive may be an epoxy or acrylic adhesive. The adhesive used must be compatible with the other layers. Suitable adhesives are, for example, Technibond 370 or T555.

The head is suitably generally disc-shaped with a diameter of around 28 mm. The conductive track is suitably around 2 mm wide and the gaps between adjacent regions of the release layer are suitably around 1 mm wide. The gap between the track and the outer edge of the release layer is suitably around 2 mm.

Figure 4:
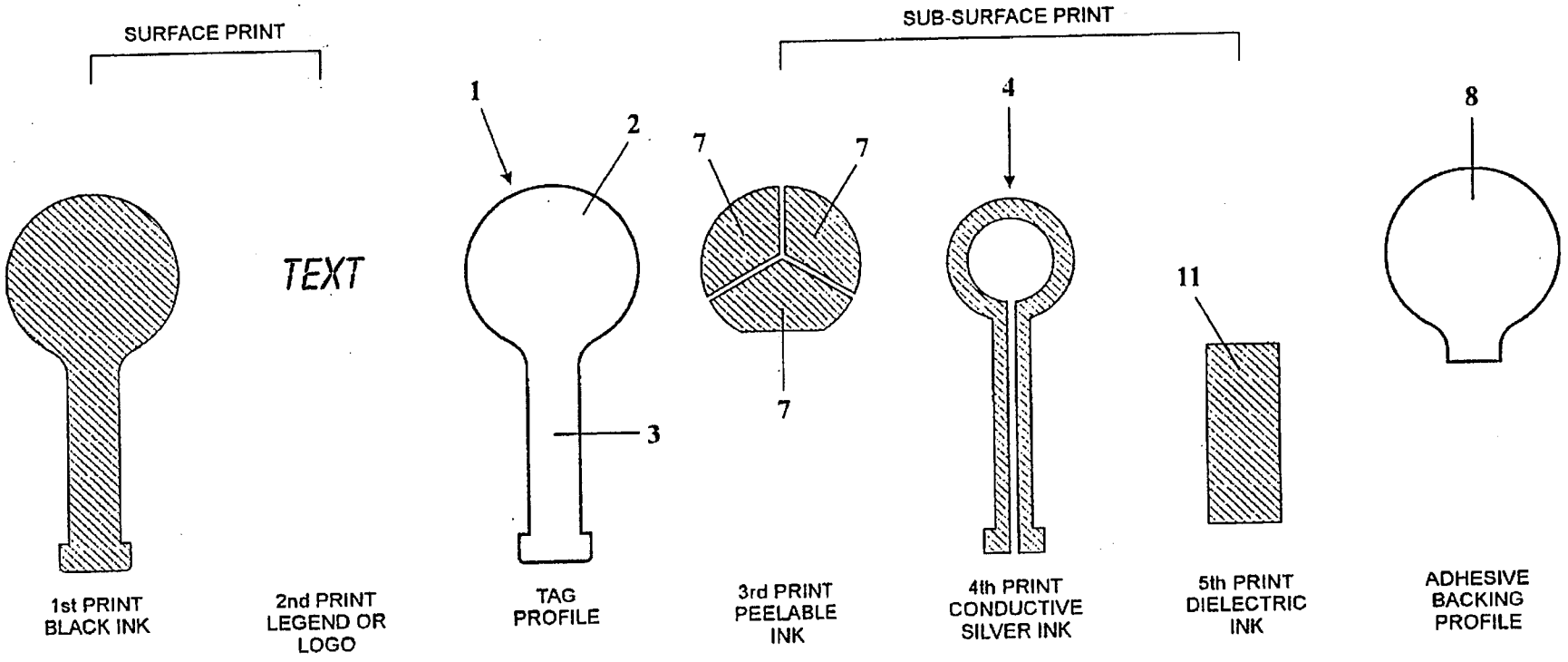
FIG. 4 is an exploded view of a second security device.

The device shown in FIG. 4 is generally similar to that of FIGS. 1 to 3 and like parts are numbered in FIG. 4 as for FIGS. 1 to 3. In the device of FIG. 4 the conductive track is formed throughout of a conductive silver-loaded ink (having a very low resistance). Contrasted with the devices of FIGS. 1 to 3 this device has the disadvantage that short-circuiting of it cannot be detected as a significant drop in resistance. However, it has the advantages that it is cheaper to manufacture (because there is no need for the carbonbearing ink to be printed on the device) and that simpler apparatus can be used to monitor the device when in use (because there is only a need to detect open or closed circuits).

The device shown in FIG. 5 has like parts numbered as for FIGS. 1 to 4. In the device of FIG. 5 the head position 2 is in the shape of an elongate strip (this allows the device to be fixed to narrow objects such as the surrounds of video camera lenses) and the tail 3 is shorter than those of the other devices (this reduces the risk of the tail of the device being tampered with to bypass the head). The conductive track 4 runs around the periphery of the head and the regions 7 of release layer lie in strips laterally across the head, with two partial strips 7a at the top of the head. This configuration has been found to be particularly sensitive. The partial strips are provided to give a closer distribution 6f the regions of release layer at the top of the head where the device is most easily peelable from a substrate.

FIG. 6 shows a connector suitable for holding the devices shown in the other Figures in contact with wires that lead to monitoring apparatus. The connector is made of insulating material (for example plastics material) and has a base block 12, a contact cover 13 joined to the base block by a hinge 14, and a wiring cover (not shown). The base block has a generally planar floor from which rise wiring walls 15,16 between which the wires run into the interior of the connector. The wiring walls include projections 17 to hold the wires in place. At their interior ends the wiring walls are separated by a spreading wall 18. The two wires pass on either side of the spreading wall and the interior ends of the wires beyond roughly the position of the spreading wall are bared to allow them to make contact with the contacts 5,6 of the devices. The wiring cover 15 has wings which snap between outer walls 19 of the base block to hold the wires in the connector. The bared wire ends (illustrated by chain dotted lines at 20) pass over a first lateral wall 21 raised from the floor of a contact region 22 of the base block.

When a connection to a device is to be made the device is placed on the base block with its contacts touching the bared wires as they pass over the first lateral wall. The shoulders 23 of the device abut against the interior edges of retaining walls 24 of the base block so that the device is held captive in the connector when the contact cover 13 is closed. The contact cover has a wing 25 which snaps over a projection 26 on the base-block to hold it closed, second lateral walls 27 and a pin 28 which mates with a recess 29 in an annular wall on the base block. The second lateral walls are formed to cooperate with the first lateral wall to press the contacts against the bared wires when the contact cover is closed. The pin serves to help hold the device in the connector by pressing against the tail of the device or by passing through a hole 30 in the tail when one is provided. If such a hole is provided it is preferably dimensioned so that the pin is a tight frictional fit in the hole. This has the effect of frictionally adhering the device to the contact cover so that if the contact cover is opened (for instance by someone tampering with the connector) the contacts of the device are lifted from the bared wires and the alarm is triggered. This makes it difficult to grin access to the contacts without triggering the alarm. As a further security feature the connector encloses part of the tail of the device to reduce the risk of the tail being tampered with.

While the invention has been particularly shown and described with reference to a preferred embodiment thereof it will be understood by those skilled in the art that various changes in form and details may be made without departing from the spirit and scope of the invention.

We claim:

1. A security device for fixing to a surface to allow relative movement of the device and the surface to be detected, the device comprising:

a substrate having a fixing portion by which the device may be fixed to the surface;

an adhesive layer for fixing the fixing portion to the surface; and circuit means defining a circuit between two locations on the device and having predetermined electrical characteristics, at least part of the circuit means being located between the substrate and the adhesive layer and having in a first region a greater adhesion with the substrate than with the adhesive layer and in a second region a greater adhesion with the adhesive layer than with the substrate so that when the device is fixed to the surface by said adhesive layer, relative movement of the substrate and the surface disrupts the circuit means by measurably changing said predetermined electrical characteristics.

2. A security device as claimed in claim 1, wherein at least part of the circuit means is located near the periphery of the fixing portion.

3. A security device as claimed in claim 1, wherein the second region is divided into a plurality of spaced apart second regions in each of which the circuit means has greater adhesion with the adhesive layer than with the substrate.

4. A security device as claimed in claim 1, wherein the adhesive layer covers the whole area of the fixing portion.

5. A security device as claimed in claim 1, wherein the substrate is opaque in the area of the fixing portion.

6. A security device as claimed in claim 1, wherein the circuit means comprises a carbon track.

7. A security device as claimed in claim 1, wherein the circuit means presents electrical resistance.

8. A security device as claimed in claim 1, wherein the circuit means is electrically conductive.

9. A security device as claimed in claim 1, comprising a contact at each of the said locations for allowing continuity or disruption of the circuit to be detected.

10. A security device as claimed in claim 1, comprising a release layer adjacent said circuit means for reducing the adhesion of said circuit means in said second region with said substrate.

11. A security device as claimed in claim 10, wherein the release layer is located between the second region of the circuit means and the substrate.

12. A security device as claimed in claim 10, wherein the release layer comprises peelable ink.

13. A security device as claimed in claim 10, wherein the release layer is sensitive to stress so that it fractures in response to deformation of the fixing portion and thereby fractures part of the circuit means.

14. A security device as claimed in claim 1, wherein the circuit means passes around substantially the whole periphery of the fixing portion.

15. A security device as claimed in claim 14, wherein the first region is divided into a plurality of first regions spaced apart around the periphery of the fixing portion at each of which the circuit means has greater adhesion with the substrate than with the adhesive layer.

16. A security device as claimed in claim 1, wherein the first region is divided into a plurality of spaced apart first regions at each of which the circuit means has greater adhesion with the substrate than with the adhesive layer.

17. A security device as claimed in claim 16, having at least three spaced-apart first regions.

18. A security device as claimed in claim 1, wherein the substrate has an elongate limb extending from the fixing portion, the circuit means extending along the limb.

19. A security device as claimed in claim 18, comprising an insulating layer extending along the limb, at least part of the circuit means being sandwiched between the limb and the insulating layer.

20. A security device as claimed in claim 18, wherein said locations are at the distal end of the limb.

21. A security device for fixing to a surface to allow relative movement of the device and the surface to be detected, the device comprising:

a substrate having a fixing portion by which the device may be fixed to the surface;

an adhesive layer for fixing the fixing portion to the surface; and circuit means defining a circuit between two locations on the device, at least part of the circuit means being located between the substrate and the adhesive layer and having in a first region a greater adhesion with the substrate than with the adhesive layer and in a second region a greater adhesion with the adhesive layer than with the substrate so that, when the device is fixed to the surface by said adhesive layer, relative movement of the substrate and the surface disrupts the circuit means due to greater adhesion of said circuit means in said first region with said substrate and greater adhesion of said circuit means in said second region with said adhesive layer, there being a release layer adjacent said circuit means for reducing the adhesion of said circuit means in said second region with said substrate.

* * * * *